United States Patent [19]

Williamson

[11] 4,206,453

[45] Jun. 3, 1980

[54] METHOD AND APPARATUS FOR ELECTRONIC SURVEILLANCE

[76] Inventor: Robert D. Williamson, 7350 NW. First Ct., Pembroke Pines, Fla. 33024

[21] Appl. No.: 883,059

[22] Filed: Mar. 3, 1978

Related U.S. Application Data

[63] Continuation-in-part of Ser. No. 689,336, May 24, 1976, Pat. No. 4,087,802, and a continuation-in-part of Ser. No. 870,673, Jan. 19, 1978.

[51] Int. Cl.[2] ..... G08B 13/22

[52] U.S. Cl. ..... 340/572; 340/505

[58] Field of Search ..... 340/572, 505

[56] References Cited

U.S. PATENT DOCUMENTS

| | | | |
|---|---|---|---|
| 3,707,711 | 12/1972 | Cole et al. | 340/572 |
| 3,895,368 | 7/1975 | Gordon et al. | 340/572 |
| 3,990,065 | 11/1976 | Purinton et al. | 340/572 |
| 3,996,555 | 12/1976 | Dow | 340/38 L |
| 4,016,553 | 4/1977 | Novikoff et al. | 340/572 |
| 4,087,802 | 5/1978 | Williamson | 340/572 |
| 4,139,844 | 2/1979 | Reeder | 340/572 |

*Primary Examiner*—Glen R. Swann, III

[57] ABSTRACT

A high frequency generator projects an electronic wave into a surveillance area to establish a first field. At least one control zone is set up within the surveillance area by two low frequency (LF) generators. The first LF generator establishes a second field in the control zone. The second LF generator establishes a third field only at a control zone margin, thereby defining the limits of the control zone. Presence within the control zone of a transponder causes reradiation of a signal comprised of the high frequency and LF signal, which provides an output signal. Additional control zones may be set up within the surveillance area by the addition of further LF generators.

21 Claims, 7 Drawing Figures

METHOD AND APPARATUS FOR ELECTRONIC SURVEILLANCE

CROSS-REFERENCE TO OTHER APPLICATIONS

This application is a continuation-in-part to Applicant's copending application, Ser. No. 689,336, filed May 24, 1976, entitled METHOD AND APPARATUS FOR ELECTRONIC SURVEILLANCE OF PRECISELY DEFINED CONTROL ZONE, now U.S. Pat. No. 4,087,802 issued May 1978 and another copending application entitled LOCK TAG, Ser. No. 870,673 filed Jan. 19, 1978.

FIELD OF THE INVENTION

The present invention relates to an improved method and apparatus for electronic surveillance that detects and may electronically locate the presence of telltale elements in one or more control zones within a larger surveillance area. More particularly, it is directed to a method and apparatus that sets up one or more control zones within a surveillance area, defines in a predetermined manner the precise dimensions of at least one of those control zones, and subjects all control zones set up to electronic surveillance, identifying which of a plurality of control zones a telltale element is within. The method and apparatus may be used for electronic monitoring of manufacturing processes, inventory control, or for pilferage control.

BACKGROUND OF THE INVENTION

Modern industrial manufacturing technology is producing ever increasing mechanization in fabrication, and inventory and quality control, frequently utilizing electronic data processors and computers. Mass production of electronic data processors, computers, software and supporting services is now widespread, but connection of this technology with a multiplicity of mechanical functions in manufacturing and everyday life has necessitated much subsidiary inventive activity. One area of major concern is the transformation of the movement of material into an electronic signal. Such material may vary from material-in-process in a factory to bulk commodities, goods, or merchandise in a warehouse or retail store. The present invention is broadly directed at all types of electronic surveillance.

It is, however, designed with circuitry that is analogous to that previously known in the field of pilferage control. In fact, while the present invention is not particularly limited to pilferage control, it is especially well suited to that application. In that application it is established to secure specifically constructed telltale tags to merchandise which is likely to be pilfered, and it is known to electronically monitor the exits of stores and ware houses, etc., where such merchandise is dispensed to ascertain that the tags are deactivated or detached in the manner provided for authorized removal of the merchandise. In the past various methods and apparatus along these lines have been employed, as recited in U.S. Pat. Nos. 3,895,368; 3,711,848; and 3,707,711, and in Applicant's copending application, Ser. No. 689,336, filed May 24, 1976, but many of these known methods and apparatus have limitations on their reliability, tolerance and sensitivity. Some are susceptible to false triggering by metallic structures coincidentally manifesting similar properties to the special tags. In some, proximity of the human body to the apparatus tends to mask the effect of the equipment and to interfere with reliable operation. Applicant's copending application, Ser. No. 689,336 overcomes these limitations but includes more circuitry at greater cost than the present invention, and is not as adaptable as the present invention to utilization of a plurality of control zones with a surveillance area, partly as a result of that cost.

The limitation on the method and apparatus disclosed in the above patents are such that their respective systems have proved incapable of discerning with a high level of reliability whether a tag has been moved into a zone being monitored, i.e. a control zone, or is merely in proximity to it. This causes too many false signals when there is no telltale element actually in a control zone, and virtually eliminates their applicability to industrial electronic surveillance usage. Moreover, the invention disclosed in U.S. Pat. No. 3,895,368 has the additional limitation that the frequencies selected for use therein were limited by an attempt to avoid frequencies that would be very susceptible to false triggering, and thus there is little or no choice of frequencies for the plurality of remotely distinguishable control zones likely to be needed for industrial applications. Furthermore, that system is subject to overrange difficulties, particularly if the LF or electrostatic signal is strengthened, as needed if employed with multiple control zones within a larger surveillance area, as contemplated by the present invention.

SUMMARY OF THE INVENTION

With the foregoing in mind, it is a principal object of the present invention to provide a method and apparatus for precisely defining at least one control zone within a larger surveillance area, within which zone or zones may be electronically detected the presence of a telltale element.

It is a further object of the present invention to permit a plurality of precisely defined control zones to be set up within a larger surveillance area.

It is a related object of the present invention to accomplish the preceding objects with the present invention while electronically detecting in which of plurality of control zones a telltale element is located.

It is another principal object of the present invention to minimize inadvertent signals from electronically monitored control zones by precise definition of those zones, thus avoiding the triggering of a signal by the presence of a telltale element in proximity to, but outside of, the control zone in question.

It is another object of the present invention to provide means which will give a subsidiary output that may serve as a warning that a telltale element has been moved close to a control zone but without actually generating a false signal that a telltale element is actually in a given control zone.

It is a resulting object that the subsidiary output provides advance notice that a telltale element is about to enter a control zone, thereby allowing more time to respond thereto.

It is a further object of the invention to provide a device which allows greater flexibility in the choice of frequencies and components capable of being used in the apparatus or in practicing the method of electronic surveillance of at least one control zone by the use of means for precisely defining the limits of those control zones.

A further principal object of the present invention is to accomplish all the foregoing objects and advantages with apparatus that is significantly simplified over what was previously known, thus permitting practice of the art at lower cost, or in permitting its use for a plurality of control zones within a surveillance area.

Another major object of the invention is to provide "plug in" capability to add in additional control zones within a larger surveillance area as needs change.

Other objects and advantages will become apparent upon reading the following descriptions of the invention and upon reference to the drawings.

In accordance with the present invention there is provided an apparatus for detecting within at least one precisely defined control zone the presence of a telltale element the heart of which is a transponder which has signal mixing capability. The apparatus includes a source of high frequency (HF) signals; means coupled to the source of the HF signals for propagating in a surveillance area an electronic wave corresponding to the HF signals, which means may include transducers or antennae; a source of first low frequency (LF) signals; a first means, which may be transducers or antennae, coupled to the source of first LF signals for establishing through a control zone within the larger surveillance area an electronic field corresponding to the first LF signals; a source of second LF signals with a frequency close to, but not the same as that of LF signals; a second means, which may also be transducers or antennae, coupled to the second LF signals for establishing throughout a control zone margin an electronic field corresponding to the second LF signals and thereby precisely defining the limits of that control zone; signal detecting means; means for coupling the detecting means with that control zone for receiving the signals therefrom, with the detecting means being constructed and arranged to detect the LF signals only when received in combination with the HF signals; a first terminal coupled to the detecting means for transmitting an output responsive to the detection, when that occurs, of the first LF signals. Alternatively, there may be provided a second terminal coupled to the detecting means for activating a subsidiary output responsive to the detection, when that occurs, of the second LF signals. This subsidiary output may serve as a warning that a telltale element is close to a control zone.

Of course additional LF signal generators may be added with accompanying means such as transducers or antennae to set additional control zones at other points in the larger surveillance area defined by the HF electronic wave. These additional control zones may either be precisely defined using a pair of LF sources, as in the first control zone, or may be proximity zone devices utilizing a single LF signal generator with connections. The system may be built so these additional LF generators, either singly or in pairs, could be merely plugged into the system with transmitting means appropriately positioned in the surveillance area and with output means also plugged in, providing significant user flexibility and inexpensive expansion.

In accordance with another aspect of the present invention there is provided a method for detecting within a control zone the presence of a transponder which has signal mixing capability, said method comprising the steps of generating HF signals to define thereby a surveillance area; propagating through at least one control zone located in the surveillance area an electronic wave corresponding to the HF signals; generating first LF signals using an oscillator (also called an LF source or signal generator); defining a control zone by propagating an electronic field corresponding to the first LF signals; generating second LF signals with another oscillator those signals having a frequency close to, but not the same as the first LF signals; establishing throughout a control zone margin an electronic field corresponding to the second LF signals to precisely define the limits of the control zone; detecting the signals in such manner as to detect the LF signals only when received in combination with the HF signals; and translating the detection, when that occurs, of first LF signals into delivery of an output. Alternatively, the method comprises the additional step of translating the detection, when that occurs, of second LF signals into delivery of a subsidiary output which may serve as a warning that a telltale element is near a control zone.

The invention will be better understood after reading the following detailed description of the embodiments thereof with reference to the appended drawings, in which:

DESCRIPTION OF THE DRAWINGS

FIG. 5 is a block diagram of the invention showing a preferred embodiment of the filters when there is utilization of both an output A and subsidiary output $A_1$.

DETAILED DESCRIPTION

Figures 1, 2, 3:
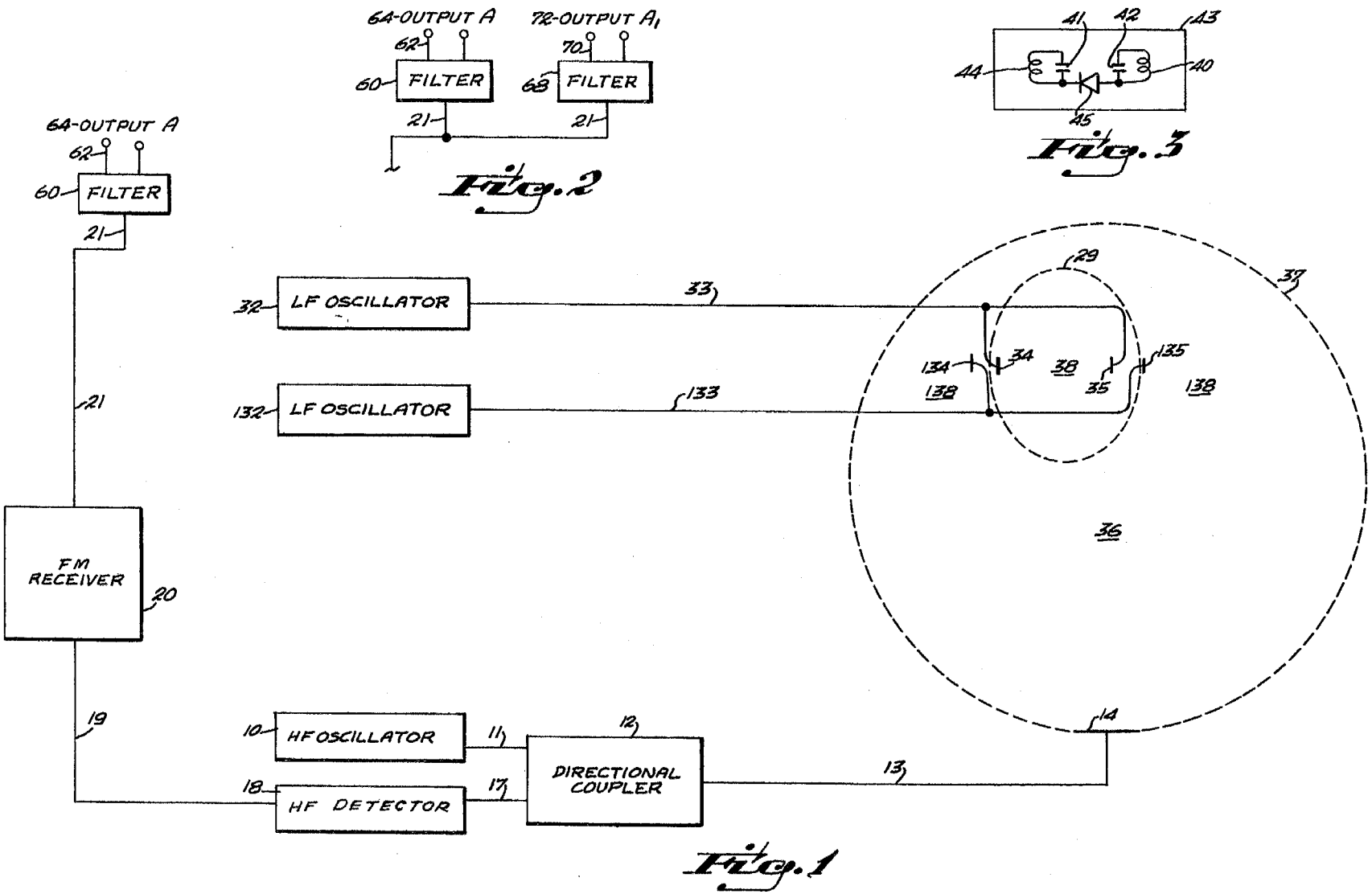
FIG. 1 is a block diagram of a preferred embodiment of the invention showing a precisely defined control zone in a larger surveillance area.
FIG. 2 is a block diagram of an alternative embodiment of the invention showing the utilization of both an output A and a subsidiary output $A_1$ warning of the approach of a telltale element to a control zone.
FIG. 3 is a schematic diagram of the circuit in a typical transponder having signal mixing capability.
Figure 3:
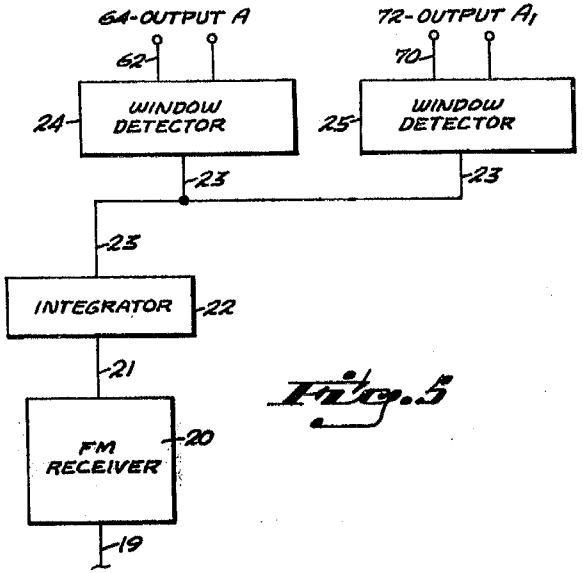

Referring to FIG. 1, an LF oscillator 32 generates first low frequency (LF) signals. The LF output of the oscillator 32 is fed via conductor 33 to signal transmitting means 34 and 35 and radiated into a control zone 38.

There is also provided another oscillator 132 which generates second LF signals with a frequency close to, but not the same as, that of the first LF signals. The LF output of the oscillator 132 is fed via conductor 133 to signal transmitting means 134 and 135 and radiated into a control zone margin 138 outboard of the control zone 38.

An HF oscillator 10 functions as a source of HF signals and has its output connected over conductor 11, to a directional coupler 12. Output of the directional coupler 12 is connected via conductor 13 to signal transmitting and receiving means 14. Optionally, a plurality of such means may be employed, connected to the directional coupler 12 in the same manner. The nature of the directional coupler 12 is such that most of the signal from the source 10 goes to the conductor 13. However, a small amount of output from the coupler 12, termed leakage, does flow through to conductor 17. This leakage is utilized to bias an HF detector 18, providing a reference.

The control zone 38 shown generally by phantom line 29 is located anywhere within the surveillance area 36 shown generally by phantom line 37. The control zone is substantially between signal transmitting means 34 and 35 which confront each other. Signal transmitting means 134 and 135 are facing the control zone margin 138 and radiate their signals toward the margin. This concentrates the energy from signal transmitting means 34 and 35 in control zone 38 and places the principal energy from the signal transmitting means 134 and 135 outboard of the control zone in the control zone margin 138.

In this configuration, when a transponder, such as shown in FIG. 3, is moved into the control zone 38, it will reradiate a composite signal to signal transmitting and receiving means 14 which will be primarily the signal radiated from signal transmitting means 34 and 35, combined with that from signal transmitting and receiving means 14. However, some of the composite signal reradiated from the transponder may be a signal component radiated from signal transmitting means 134 and 135 combined with a signal component from transmitting and receiving means 14.

The signals received by signal transmitting and receiving means 14 pass through conductor 13 to the directional coupler 12, isolated from signals on path 11, and sent out conductor 17 to the HF detector 18. In a known and standard manner, the HF detector 18 will remove the HF component and supply the detected LF signals via path 19 to the FM receiver 20.

The FM receiver 20 is tuned so its pass band includes both of the similar but not equal frequencies of oscillators 32 and 132. It is a well known fact that an FM receiver will only "lock on" to the strongest of a plurality of slightly different signals that are within its pass band. Therefore, the FM receiver 20 will select the LF signal radiated from signal transmitting means 34 and 35 while the transponder is in the control zone 38, despite the fact that some signal from transmitting means 134 and 135 may have also been picked up. This is because signal radiated from transmitting means 34 and 35 will be stronger when the transponder is in the control zone 38 than the signal from transmitting means 134 and 135.

In like manner, if the transponder is moved outboard to the control zone margin 138, the composite signal reradiated to signal transmitting and receiving means 14 will be primarily the signal radiated from signal transmitting means 134 and 135 combined with the HF signal later removed by HF detector 18. Secondarily, signals from transmitting means 34 and 35 may be included in the composite signal, but the FM receiver 20 will again "lock on" to the strongest signal, in this case the one radiated from signal transmitting means 134 and 135 because the transponder is in the control zone margin 138.

The output of FM receiver 20 will be randomed or "white" noise when no transponder, such as shown in FIG. 3, or telltale element, is in a position to mix signals from HF oscillator 10 and one of the LF oscillators. However, when there is signal mixing from a transponder, the FM receiver output will be a voltage having a DC characteristic that is proportional to the difference in the frequencies of the LF signal received and the frequency of the center of the FM receiver pass band.

The output of FM receiver 20 is connected via conductor 21 to filter 60. Filter 60 is constructed such that signals from transmitting means 34 and 35, which originated in oscillator 32, will pass through it. However, other signals will not. Thus, if the transponder is located in the control zone margin 138, and signals from transmitting means 134 and 135 accordingly predominate over signals from transmitting means 34 and 35, the FM receiver 20 will lock on to the signals from the transmitting means 134 and 135 which originate in oscillator 132, and the ouput from FM receiver 20 will exclude any signals to which filter 60 is receptive. Therefore, when the transponder is in the control zone margin 138, the output from FM receiver 20 will be eliminated by filter 60, and there will be no signal to reach terminal 62. Thus there will be no Output A at 64.

Contrarywise, if the transponder is moved into the control zone 38, signals from transmitting means 34 and 35, originating in oscillator 32, will predominate and will pass through FM receiver 20 via conductor 21 to filter 60, which will pass those signals through to terminal 62, rendering output at 64. Output A could be used for numerous purposes including connection to a data acquisition system for a computer or merely to activate an alarm.

Turning now to FIG. 2, there is shown an alternative embodiment, wherein the output of the FM receiver 20 is additionally connected via a conductor 21 to a filter 68. This filter 68 is constructed such that signals from transmitting means 134 and 135, which originated in oscillator 132, will pass through it. However, other signals will not. Filter 68 is connected via terminal 70 to a transmit Output $A_1$ at 72, which may serve as a warning and which also may be connected to a data acquisition system for use by a computer.

FIG. 3 shows a preferred embodiment of the transponder circuit, wherein each terminal of a diode 45 is connected to parallel inductance and capacitance elements, 41 and 44 and 40 and 42 respectively which are embedded in a carrier and comprises a telltale element 43. The circuit is passive, requiring no battery or other power source connected to it. This circuit may be embodied in numerous ways, including an unbreakable capsule for industrial applications or in paper or plastic tags, such as disclosed and claimed in Applicant's copending application for a "Lock Tag", Ser. No. 870,673 filed Jan. 19, 1978.

Figure 4:
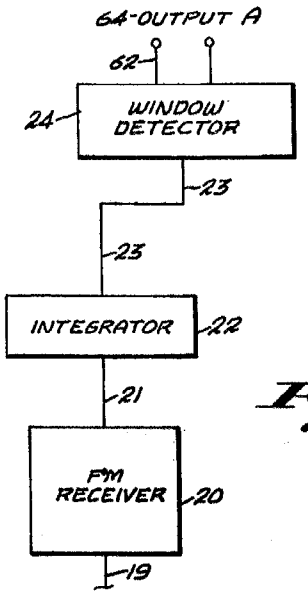
FIG. 4 is a block diagram of the invention showing a preferred embodiment of the filter shown in FIG. 1.

Turning now to FIG. 4, there is illustrated a preferred embodiment of the filter 60 shown in FIG. 1. As noted above, the output of FM receiver will be random noise when no telltale element is in a position to mix signals from the HF oscillator and one of the LF oscillators. However, when there is signal mixing from a telltale element, the FM receiver output will have a DC characteristic that is proportional to the deviation of the LF signal received from the center of the FM receiver pass band. In FIG. 4, that DC output from FM receiver 20 will be connected via conductor 21 to an integrator 22, thence over conductor 23 to a window detector 24. Window detector 24 is designed to put out a signal at terminal 62 as Output A at 64 if the signal characteristics are such that they emanated from LF oscillator 32. Any other signal will not activate the window detector output to terminal 62, resulting in no Output A at 64.

FIG. 5 illustrates the preferred embodiment of the alternative shown in FIG. 2, utilizing the same type of members used in FIG. 4. If FM receiver 20 is delivering (through conductor 21, integrator 22 and conductor 23)

a signal emanating from oscillator 132, then window detector 25 will put out a signal to terminal 70 as subsidiary Output $A_1$ at 72 because window detector 25 is designed to react only to such signals. Any other signal, such as one emanating from oscillator 32 will not cause an output at terminal 70 resulting in no subsidiary Output $A_1$ at 72.

Figure 6:
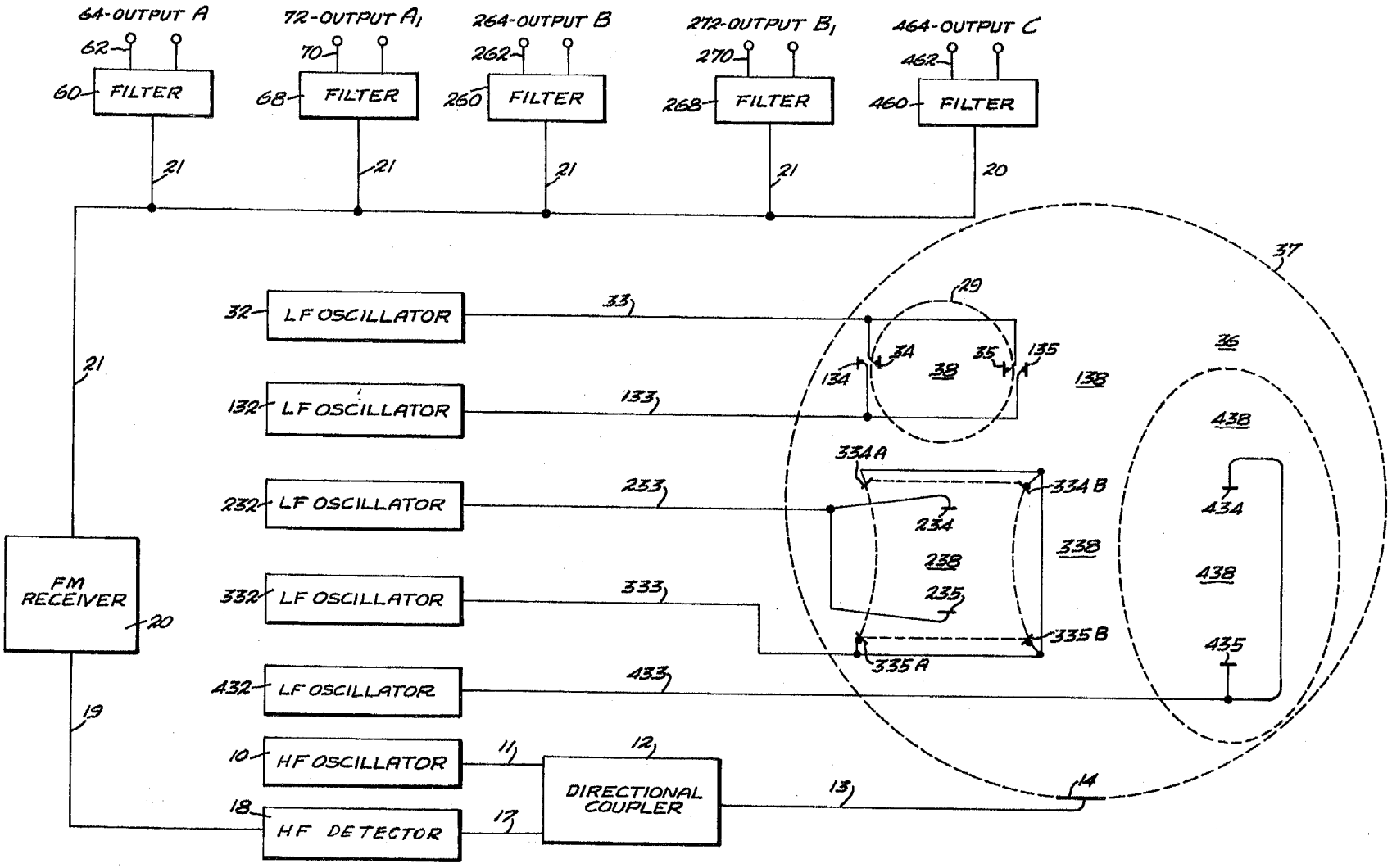
FIG. 6 is a block diagram of an alternative embodiment of the invention showing two precisely defined control zones having differing geometry and one proximity zone.

FIG. 6 illustrates an alternative embodiment in which are included two precisely defined control zones 38 and 238, as well as a proximity zone 438. Description of control zone 38, control zone margin 138, and the use of HF oscillator 10 and LF oscillators 32 and 132 to create three electronic fields will not be repeated, since it is identical to that description relating to FIG. 1.

LF oscillators 232 and 332 are used with HF oscillator 10 to create three fields with respect to control zone 238. HF oscillator 10 does so in the same manner as in FIG. 1, through conductor 11 to directional coupler 12, to conductor 13 to signal transmitting and receiving means 14. LF oscillator 232 does so through conductor 233 to signal transmitting means 234 and 235. LF oscillator 332 does so through conductor 333 to signal transmitting means 334A, 334B, 335A and 335B. The use of a different geometry and more signal transmitting means for LF oscillator 332 is to illustrate that the control zone margin 338 can be reshaped and even more precisely defined than control zone margin 138 with respect to control zone 38 in FIG. 1.

Signals are received in the same manner with respect to control zone 238 and control zone margin 338 as described for FIG. 1 (for control zone 38 and margin 138), i.e. through signal transmitting and receiving means 14, conductor 13, directional coupler 12, conductor 17, HF detector 18, FM receiver 20, and conductor 21. LF oscillators 232 and 332 must also have different frequencies than any other oscillators in the system, but must be within the FM receiver pass band nonetheless. FM receiver 20 will still lock on to the strongest signal and will pass on that signal to the filters 60 and 68 already described, as well as analogous filters 260 and 268. These in turn will yield outputs B or $B_1$ when, respectively, signals emanating from oscillators 232 or 332 predominate in the FM receiver 20 output.

FIG. 6 also discloses a single additional LF oscillator 432, meeting the same requirements as to frequency as all the other LF oscillators, and connected through conductor 433 to signal transmitting means 434 and 435. This creates a proximity zone 438 with some over-range (behind signal transmitting means 434 and 435) and without the precise definition of control zone 238 or 38. If a transponder enters proximity zone 438, signal mixing will occur between LF oscillator 432 and HF oscillator 10 signals, resulting in a DC output from FM receiver 20, for which additional filter 460 is designed, and this will yield Output C at 464 from terminal 462. There can be no Output $C_1$ without a further additional LF oscillator and connections.

Figure 7:
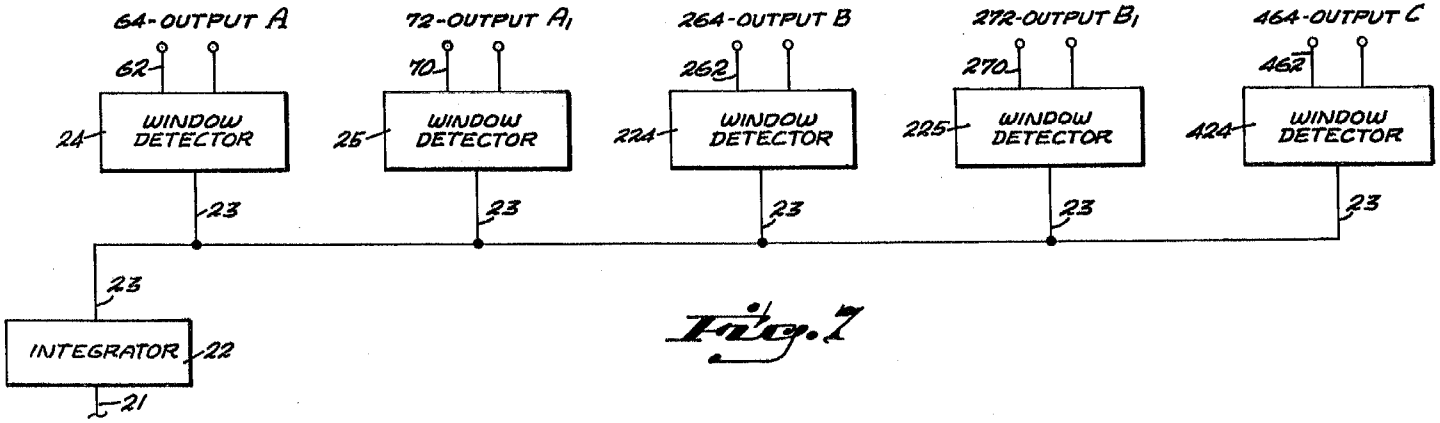
FIG. 7 is a block diagram of the preferred embodiment of the filters shown in FIG. 6.

Turning finally to FIG. 7, the preferred embodiments of filters 60, 68, 260, 268 and 460 are illustrated. The pattern of FIG. 5 is followed, with all window detectors 24, 25, 224, 225, 424 being connected by conductor 23 to integrator 22. Window detector 224 yields Output B at 264 through terminal 262. Window detector 225 yields Output $B_1$ at 272 through terminal 270. Window detector 424 yields Output C at 464 through terminal 462. Of course, more control and proximity zones may be set up in the same manner, and could be merely plugged in.

It will be appreciated from the foregoing, that substantial advantages accrue from the present invention. These include setting up a plurality of precisely defined control zones in a larger surveillance area, and being able to do so with significantly simplified equipment over what is being disclosed in Applicant's copending application, Ser. No. 689,336 filed May 24, 1976. They also include the facility to change the geometry of the control zones and to plug in additional control zones as needed within a larger surveillance area, both features tending to provide great flexibility in the use of the system.

Having described the presently preferred embodiments of the invention it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined by the appended claims.

What is claimed is:

1. A method for setting up within a surveillance area at least one precisely defined control zone and detecting within that control zone and that control zone's margin the presence of a transponder having signal mixing capability comprising the steps of:

generating HF signals;

propagating through the surveillance area an electronic wave corresponding to the HF signals;

generating first LF signals for each control zone, with a frequency different than that of any other LF signals, but close enough thereto to all be within the pass band of an FM receiver;

establishing through each control zone an electronic field corresponding to the first LF signals generated for that control zone;

generating second LF signals for each control zone with a frequency different than that of any other LF signals, but close enough thereto to all be within the pass band of the FM receiver;

establishing a control zone margin for each control zone with an electronic field corresponding to the second LF signals for that control zone thereby precisely defining that control zone;

detecting the signals in such manner as to detect the LF signals only when received in combination with HF signals; and translating the detection of any control zone's first LF signals into an electronic output for that zone when the first LF signals predominate over the second LF signals for that zone.

2. The method of claim 1, wherein detecting the signals in such manner as to detect the LF signals only when received in combination with HF signals further comprises removing HF signals from composite HF and LF signals received.

3. The method of claim 1, wherein translating the detection of any control zone's first LF signals into an electronic output for that zone when the first LF signals predominate over the second LF signals for that zone comprises the steps of:

conducting the LF signals to the FM receiver for selection of the strongest LF signal;

feeding the FM receiver output to a filter;

filtering out all FM receiver output signals except those having the characteristics of that zone's first LF signals; and delivering remaining signals to a first terminal for that zone as an electronic output.

4. The method of claim 3, wherein feeding the FM receiver output to a filter and filtering out all FM receiver output signals except those having the characteristics of that zone's first LF signals comprise the steps of:

feeding the FM receiver output to an integrator;

integrating same therein; and conducting output of the integrator to a window detector in which a window is set to react only to those signals whose deviation from the center of the FM receiver pass band is substantially the same as signals emanating from a generator of first LF signals for that zone.

5. The method of claim 1 further comprising:

translating the detection of any control zone's second LF signals into a subsidiary electronic output for that zone only when the second LF signals predominate over the first LF signals for that zone.

6. The method of claim 5, wherein translating the detection of any control zone's first and second LF signals, respectively, into an electronic output and a subsidiary electronic output for that zone comprises the steps of:

supplying any LF signals detected to an FM receiver for selection of the strongest LF signals;

feeding the FM receiver output to a pair of filters in parallel for each control zone, filtering out with a first filter all FM receiver output signals except those having the characteristics of that zone's first LF signals;

delivering signals remaining after the first filter to a first terminal for that zone as an electronic output;

filtering out with a second filter all FM receiver output signals except those having the characteristics of that zone's second LF signals; and delivering signals remaining after the second filter to a second terminal for that zone as a subsidiary electronic output.

7. The method of claim 6, wherein the steps of feeding the FM receiver output to a plurality of filters in parallel, filtering with a first and second filter all FM receiver output signals, and delivering remaining signals to a first and a second terminal for that zone, respectively, as an electronic output and a subsidiary electronic output comprise the steps of:

feeding the FM receiver output to an integrator;

integrating same therein;

conducting output of the integrator to a pair of window detectors in parallel for each control zone, a first and a second of which have windows set to react only to those signals whose deviations from the center of the FM receiver pass band are substantially the same as signals emanating, respectively, from generators of the first and second LF signals for that zone;

delivering signals remaining after the first window detector to a first terminal for that zone as an electronic output; and delivering signals emanating from the second window detector to a second terminal for that zone as a subsidiary electronic output.

8. The method of claim 1, which further includes setting up in the surveillance area at least one proximity zone and detecting within that proximity zone the presence of a transponder having signal mixing capability comprising the steps of:

generating LF signals for each proximity zone with a frequency different than that of any other LF signals, but close enough thereto to all be within the pass band of an FM receiver;

establishing through each proximity zone an electronic field corresponding to the LF signals generated for that proximity zone;

detecting the signals in such manner as to detect the LF signals only when received in combination with the HF signals; and translating the detection of any proximity zone's LF signals into an electronic output for that zone.

9. The method of claim 8, wherein detecting the signals in such manner as to detect LF signals only when received in combination with HF signals further comprises removing HF signals from composite HF and LF signals received.

10. The method of claim 8, wherein translating the detection of any proximity zone's LF signals into an electronic output for that zone comprises the steps of:

conducting the LF signals to the FM receiver;

feeding the FM receiver output to a filter;

filtering out all FM receiver output signals except those having the characteristics of that zone's LF signals; and delivering remaining signals to a terminal for that zone as an electronic output.

11. The method of claim 10, wherein feeding the FM receiver output to a filter and filtering out all FM receiver output signals except those having the characteristics of that zone's LF signals comprise the steps of:

feeding the FM receiver output to an integrator;

integrating same therein; and conducting the output of the integrator to a window detector in which a window is set to react only to those signals whose deviation from the center of the FM receiver pass band is substantially the same as signals emanating from a generator of LF signals for that zone.

12. An apparatus for setting up within a surveillance area at least one precisely defined control zone and detecting within that control zone and that control zone's margin the presence of a transponder having signal mixing capability comprising:

an HF signal generator;

means coupled to the HF signal generator for propagating through the surveillance area an electronic wave corresponding to the HF signals generated;

a source of first LF signals for each control zone, such signals having a frequency different than that of any other LF signals, but close enough thereto to all be within the pass band of an FM receiver;

a first means coupled to the source of first LF signals for each control zone for establishing through that control zone an electronic field corresponding to the first LF signals generated for that control zone;

a source of second LF signals for each control zone, such signals having a frequency different from that of any other LF signals, but close enough thereto to all be within the pass band of the FM receiver;

a second means coupled to the source of second LF signals for each control zone for establishing a control zone margin for each control zone with an electronic field corresponding to the second LF signals for that control zone thereby precisely defining that control zone;

signal detecting means constructed to detect LF signals only when received as a composite with the HF signals;

means for coupling the signal detecting means with the surveillance area for receiving the signals therefrom; and a means coupled to the signal detecting means delivering an electronic output for any control zone in response to detection of first LF signals for that control zone, when those first LF signals predominate over that control zone's second LF signals.

13. The apparatus of claim 12, wherein the signal detecting means constructed to detect LF signals only when received as a composite with the HF signals further comprises an HF detector which removes the HF signal from the detected composite HF and LF signals.

14. The apparatus of claim 12, wherein the means delivering an electronic output for any control zone in response to detection of first LF signals for that control zone, when those first LF signals predominate over that control zone's second LF signals comprises:

an FM receiver connected to the signal detecting means to select the strongest LF signals;

a filter connected to the output of the FM receiver to filter out all LF signals except those having the characteristics of that control zone's first LF signals; and a terminal for that zone connected to the output of the filter to which terminal is delivered the electronic output from the filter.

15. The apparatus of claim 14, wherein the filter comprises:

an integrator common to all zones and connected to the output of the FM receiver to integrate the output thereof; and a window detector for each control zone connected to the output of the integrator, each said window detector having a window set to react only to those signals whose deviation from the center of the FM receiver pass band is substantially the same as signals emanating from the source of first LF signals for that zone.

16. The apparatus of claim 12, further comprising a means coupled to the signal detecting means delivering a subsidiary electronic output for any control zone in response to the detection of second LF signals for that control zone, when those second LF signals predominate over that control zone's first LF signals.

17. The apparatus of claim 16, wherein the means coupled to the signal detecting means delivering an electronic output and a subsidiary electronic output for any control zone in response to the detection, respectively, of the predominance of that control zone's first LF signals and the predominance of that control zone's second LF signals comprises:

an FM receiver connected to the signal detecting means to select the strongest LF signals;

a pair of filters in parallel for each control zone connected to the output of the FM receiver, a first filter of which is to filter out all LF signals except those having the characteristics of that control zone's first LF signals;

a first terminal for that control zone connected to the output of the first filter, to which terminal is delivered the electronic output from the first filter;

a second filter also connected to the output of the FM receiver to filter out all LF signals except those having the characteristics of that control zone's second LF signals; and a second terminal for that control zone connected to the output of the second filter, to which terminal is delivered the subsidiary electronic output from the second filter.

18. The apparatus of claim 17, wherein the first and second filter for each control zone comprise:

an integrator common to all zones and connected to the output of the FM receiver to integrate the output thereof;

a pair of window detectors in parallel for each control zone connected to the output of the integrator, said window detectors each having a window set to react only to those signals whose deviation from the center of the FM receiver pass band is substantially the same as signals emanating respectively from the sources of first and second LF signals for that zone.

19. The apparatus of claim 12, which further includes means for setting up in the surveillance area at least one proximity zone and detecting within that proximity zone the presence of a transponder having signal mixing capability comprising:

a source of LF signals for each proximity zone, such signals having a frequency different than that of any other LF signals, but close enough thereto to all be within the pass band of an FM receiver;

a means coupled to the source of LF signals for each proximity zone for establishing through that proximity zone an electronic field corresponding to the LF signals generated for that proximity zone; and a means coupled to the signal detecting means delivering an electronic output for any proximity zone in response to the detection of LF signals for that zone.

20. The apparatus of claim 19, wherein the means delivering an electronic output for any proximity zone comprises:

an FM receiver connected to the signal detecting means to select the strongest LF signals;

a filter connected to the output of the FM receiver to filter out all LF signals except those having the characteristics of that proximity zone's LF signals; and a terminal for that zone connected to the output of the filter to which terminal is delivered the electronic output of the filter.

21. The apparatus of claim 20, wherein the filter comprises:

an integrator common to all zones and connected to the output of the FM receiver to integrate the output thereof; and a window detector for each proximity zone connected to the output of the integrator, said window detector having a window set to react only to those signals whose deviation from the center of the FM receiver pass band is substantially the same as signals emanating from the source of LF signals for that zone.

* * * * *